United States Patent [19]

Miyauchi et al.

[11] Patent Number: 4,617,582

[45] **Date of Patent: * Oct. 14, 1986**

[54] HEAT-SENSITIVE RECORDING SHEET

[75] Inventors: Masahiro Miyauchi; Masahiro Higuchi, both of Tokyo, Japan

[73] Assignee: Mitsubishi Paper Mills, Ltd., Tokyo, Japan

[ * ] Notice: The portion of the term of this patent subsequent to May 6, 2003 has been disclaimed.

[21] Appl. No.: 622,246

[22] Filed: Jun. 19, 1984

Related U.S. Application Data

[63] Continuation-in-part of Ser. No. 494,312, May 13, 1983.

[30] Foreign Application Priority Data

May 14, 1982 [JP] Japan ..... 57-82131
Jun. 1, 1982 [JP] Japan ..... 57-92154

[51] Int. Cl.[4] ..... B41M 5/18

[52] U.S. Cl. ..... 346/208; 346/209; 346/214; 346/216; 427/150; 427/151

[58] Field of Search ..... 346/208, 209, 207, 200, 346/225, 214, 216; 427/150, 151, 157

[56] References Cited

U.S. PATENT DOCUMENTS 4,503,446 3/1985 Yahagi et al. ..... 346/216

FOREIGN PATENT DOCUMENTS 0059975 9/1982 European Pat. Off. ..... 346/209
0005636 1/1978 Japan ..... 346/208
0041994 3/1982 Japan ..... 346/208
0116690 7/1982 Japan ..... 346/208
00126693 8/1982 Japan ..... 346/208

*Primary Examiner*—Bruce H. Hess
*Attorney, Agent, or Firm*—Cushman, Darby & Cushman

[57] ABSTRACT

In a heat-sensitive recording sheet having a heat-sensitive coating layer comprising a colorless to light-colored dye precursor as color former and a color developer which causes said dye precursor to develop a color by reacting with said dye precursor when heated, the color development sensitivity of said sheet, particularly at low temperatures, is enhanced by using benzyl p-hydroxybenzoate as said color developer and allowing said heat-sensitive coating layer to further comprise a terephthalic acid ester having a melting point of 60° C. or higher and a fatty acid amide or derivative thereof having a melting point of 60° C. or higher.

24 Claims, No Drawings

HEAT-SENSITIVE RECORDING SHEET

CROSS-REFERENCE TO RELATED APPLICATION

This application is a continuation-in-part of copending application Ser. No. 494,312 filed May 13, 1983.

BACKGROUND OF THE INVENTION

1. Field of the Invention

This invention relates to a heat-sensitive recording sheet having an ability of highly sensitive color development.

2. Description of the Prior Art

In recent years, the heat-sensitive recording method has come to possess various advantages such that it gives almost no impact and accordingly is noiseless, development and fixation is not required and equipment maintenance is simple. Therefore, the method is widely used not only in various printers and telephone facsimile but also in many other areas. In the field of the telephone facsimile, the heat-sensitive system has been popularized sharply, which is being improved to a faster speed type for reduction of transmission cost. To respond to the speed-up of facsimile, an increased sensitivity has come to be required for heat-sensitive recording materials.

In the facsimile of faster speed type, since a standard manuscript of an A4 size is transmitted and received in 20 sec to 1 min, electricity runs through a thermal head of the facsimile only for a very short period of time of 1 to 2 msec and a heat energy generated by the electricity is transmitted to a heat-sensitive recording sheet, whereby images are formed. In order to allow a heat energy transmitted in such a short period of time to conduct an image-forming reaction, there is needed a heat-sensitive recording sheet excellent in heat response. This requirement of excellent heat response does become more stringent particularly when the facsimile is used at a low temperature of 10° C. or below.

Ordinarily, heat-sensitive recording sheets contain, as essential components, a dye precursor and a color developer. A method for increasing the sensitivity of a heat-sensitive recording sheet by allowing the heat-sensitive coating layer of the sheet to contain a heat-meltable substance is disclosed in Japanese Patent Publication No. 4160/1968.

Heat-meltable substances have a function that, when they are melt by a heat energy transmitted, they dissolve or include a dye precursor or a color developer or both and they accelerate their color-developing reaction. However, these heat-meltable substances do not develop colors by themselves and, while giving the sensitizing effect, cause various inconveniences such that they cause blotting or feathering in developed color portions or cover the developed color portions and thereby cause density reduction, namely dilution and further they produce work-ups or stickings. Accordingly, heat-meltable substances have a limitation in sensitivity-increasing effect when they are used alone.

Hence, there have been made studies for enhancing the heat response of dye precursors or color developers which are both directly related to color development. However, in the case of dye precursors, utilizable dye precursors are small in number at present considering from characteristics after color development, cost, manufacturing problems, etc., and selection of dye precursors having excellent heat response from among such a small number is difficult practically. On the other hand, in the case of color developers, it is known that benzyl p-hydroxybenzoate described in Japanese Patent Application Kokai (Laid-open) No. 74762/1979 has excellent heat response, but this compound has a drawback of giving unstable images. In the case of color developers, it is also known as described in Japanese Patent Publication No. 72996/1981 that inclusion of one or two or more kinds of terephthalic acid esters improves image stability and further is effective for heat sensitivity.

To respond to changes of recording equipments associated with the speed-up of recording speed as well as to a requirement of high density recording under a low temperature atmosphere of 10° C. or below, there have been desired the advent of a heat-sensitive recording sheet with increased color-development sensitivity particularly at low temperatures.

Even in high speed facsimile equipments, the pattern of transmitting heat energy onto a heat-sensitive recording sheet varies at times depending upon remittance modes, because there are cases that these high speed facsimile equipments are connected to low or medium speed facsimile equipments of older type for enabling their reciprocal communication. Specifically explaining, in the case of a low or medium speed remittance mode, a time for heat remittance becomes longer and therefore, when the energy quantity transmitted is fixed constant, the temperature of a thermal head which is a heat-generating element is controlled at a relatively low temperature or the scanning line density is reduced. This presents a very severe condition for high density recording at low temperature atmosphere.

SUMMARY OF THE INVENTION

An object of this invention is to provide a heat-sensitive recording sheet having improved the drawbacks of the prior arts and having an ability of highly sensitive color development particularly at low temperatures.

This and other objects and advantages of the invention may be readily ascertained by referring to the following description.

The object of this invention is achieved by a heat-sensitive recording sheet having a heat-sensitive coating layer comprising a colorless to light-colored dye precursor as color former and a color developer which causes said dye precursor to develop a color by reacting with said dye precursor when heated, characterized in that benzyl p-hydroxybenzoate is used as said color developer and said heat-sensitive coating layer further comprises a terephthalic acid ester having a melting point of 60° C. or higher and a fatty acid amide or derivative thereof having a melting point of 60° C. or higher.

DETAILED DESCRIPTION OF THE PREFERRED EMBODIMENTS

Terephthalic acid esters used in the heat-sensitive recording sheet of this invention are restricted to those having a melting point of 60° C. or higher in order to prevent background fogging occuring in the drying process after application of a heat-sensitive coating layer on a substrate sheet.

Terephthalic acid esters having a melting point lower than 60° C. (for example, diethyl terephthalate having an m.p. of 43.2° C.) can not be used practically because these cause background fogging in the drying process after application of a heat-sensitive coating layer.

As terephthalic acid esters having a melting point of 60° C. or higher usable in this invention, there are mentioned, for example, monoethyl terephthalate (m.p. 165° C.), monopropyl terephthalate (m.p. 127° to 129° C.), monoisopropyl terephthalate (m.p. 166° C.), monobutyl terephthalate (m.p. 122° to 124° C.), monoisobutyl terephthalate (m.p. 151° to 154° C.), mono-n-octyl terephthalate (m.p. 82° to 84° C.), monocyclohexyl terephthalate (m.p. 160° to 162° C.), dimethyl terephthalate (m.p. 140° C.), di-t-butyl terephthalate (m.p. 118° C.), dicyclohexyl terephthalate (m.p. 75° to 80° C.), dimethyl 2-methylterephthalate (m.p. 73° C.), dimethyl 2-chloroterephthalate (m.p. 60° C.), dimethyl 2,5-dichloroterephthalate (m.p. 136° C.), diethyl 2-bromo-5-chloroterephthalate (m.p. 115° to 116.5° C.), diphenyl terephthalate (m.p. 191° C.), dibenzyl terephthalate (m.p. 96° to 98° C.), etc.

As the fatty acid amide or derivative thereof having a melting point of 60° C. or higher usable in this invention, there are mentioned amide type waxes such as saturated fatty acid amides (lauramide, stearamide, palmitamide, coconut acid amide, behenamide and the like), unsaturated fatty acid amides (oleamide, erucamide, ricinoleamide and the like), fatty acid amide derivatives (N-cyclohexylstearamide, N-cyclohexylpalmitamide, N-ethylstearamide, N-ethylpalmitamide, N-stearylstearamide, N-stearylbenzamide, N-stearylphenylacetamide, N-hydroxymethylstearamide, ethylenebis-stearamide and the like); and so forth. These can be used alone or in combinations of two or more as fine powders or as emulsions.

The fatty acid amide or derivative thereof is added preferably in an amount of 10 to 100% by weight, more preferably of 10 to 60% by weight, and particularly preferably of 15 to 20% by weight based on the amount of benzyl p-hydroxybenzoate.

The terephthalic acid ester is added preferably in an amount of 10 to 100% by weight, more preferably of 10 to 60% by weight, and particularly preferably of 30 to 35% by weight based on the amount of benzyl p-hydroxy benzoate.

Preferably the amount of fatty acid amide or derivative thereof is an amount of 10 to 100% by weight and simultaneously the amount of terephthalic acid ester is an amount of 10 to 100% by weight, respectively, based on the amount of benzyl p-hydroxybenzoate. More preferably the amount of fatty acid amide or derivative thereof is an amount of 10 to 60% by weight and simultaneously the amount of terephthalic acid ester is an amount of 10 to 60% by weight. Particularly preferably the amount of fatty acid amide or derivative thereof is an amount of 15 to 20% by weight and simultaneously the amount of terephthalic acid ester is an amount of 30 to 35% by weight. Preferably the total amount of terephthalic acid ester and fatty acid amide or derivative thereof is less than 1.2 times by weight, particularly less than 0.6 time by weight, respectively, based on the amount of benzyl p-hydroxybenzoate which is the aforementioned color developer.

In the heat-sensitive coating layer also pigments may be contained in an amount of 15 to 30% by weight based on the total solids of the heat-sensitive coating layer. As the pigments there are mentioned, for example, diatomaceous earth, talc, kaolin, calcinated kaolin, calcium carbonate, magnesium carbonate, titanium oxide, zinc oxide, silicon oxide (silica), aluminum hydroxide, urea-formaldehyde resin, etc. Particularly, it is preferable to use calcium carbonate, silicon oxide (silica) or their mixture. In case both calcium carbonate and silicon oxide (silica) are used together, their weight ratio is preferably 1:9 to 3:7.

Particularly preferred is a case wherein the heat-sensitive coating layer comprises benzyl p-hydroxybenzoate in 2–3 times by weight based on the dye; stearamide and/or ethylene bis-stearamide as the fatty acid amide or derivative thereof in 15–20% by weight based on the color developer; dimethyl terephthalate and/or monobutyl terephthalate and/or dibenzyl terephthalate as the terephthalic acid ester in 30–35% by weight based on the color developer; and calcium carbonate and/or silica as the pigment in 15–30% by weight based on the total solids of the heat-sensitive coating layer. In this case, the weight ratio of calcium carbonate to silica is 1:9 to 3:7.

Addition of terephthalic acid esters and fatty acid amides or derivatives thereof in excessive amounts is not desirable from the standpoint of cost, wastes heat energy transmitted, reduces the density of developed color portions (i.e. has dilution effect) because none of them develop a color by themselves, and further causes scums and sticks which give various damages.

According to this invention, benzyl p-hydroxybenzoate, a terephthalic acid ester having a melting point of 60° C. or higher and a fatty acid amide or derivative thereof having a melting point of 60° C. or higher are ground and dispersed separately or together in a grinder into fine particles and then are mixed with a dye precursor, a binder, a pigment, etc. which have all been ground and dispersed similarly and, if necessary, to the resulting mixture are added various additives such as a surfactant, a brightener and the like, whereby there is prepared a coating color.

Next, dye precursors, binders, pigments and substrates used in the heat-sensitive recording sheet of this invention will be explained.

(1) Dye Precursor

There can be used dye precursors which are employed generally in heat-sensitive papers. They are, for example, Crystal Violet Lactone, 3-diethylamino-7-methylfluoran, 3-diethylamino-6-chloro-7-methylfluoran, 3-diethylamino-6-methyl-7-chlorofluoran, 3-diethylamino-7-anilinofluoran, 3-diethylamino-7-(2-chloroanilino)fluoran, 3-dibutylamino-7-(2-chloroanilino)fluoran, 3-diethylamino-7-(3-chloroanilino)fluoran, 3-diethylamino-6-methyl-7-anilinofluoran, 3-(N-ethyl-p-toluidino)-6-methyl-7-anilinofluoran, 3-(N-methylcyclohexylamino)-6-methyl-7-anilinofluoran, 3-piperidino-6-methyl-7-anilinofluoran, etc.

(2) Binder

For example, starches, hydroxyethyl cellulose, methyl cellulose, polyvinyl alcohols, styrene-maleic anhydride copolymers, styrene-butadiene copolymers, polyacrylic amides, etc.

(3) Subtrate

Any of papers, synthetic papers, synthetic resin films, etc. can be used, however, papers are generally used.

Hereinunder, this invention will be explained more specifically by way of Examples, but the invention is not restricted by these Examples.

EXAMPLE 1

| | |
|---|---|
| (1) Fluid A (dispersion of benzyl p-hydroxybenzoate) | |
| Benzyl p-hydroxybenzoate | 175 g |
| Malon MS-25 (25% aqueous solution of a sodium salt of a styrene-maleic anhydride copolymer, manufactured by Daido Kogyo K.K.) | 35 g |
| Water | 290 g |
| The above mixture is ground and dispersed for 48 hr in a ball mill. | |
| (2) Fluid B (dispersion of a terephthalic acid ester) | |
| Dimethyl terephthalate (m.p. 140 to 142° C.) | 175 g |
| 10% Aqueous solution of an ammonium salt of a styrene-maleic anhydride copolymer | 87.5 g |
| Water | 237.5 g |
| The above mixture is ground and dispersed for 48 hr in a ball mill. | |
| (3) Fluid C (dispersion of a dye precursor) | |
| 3-Diethylamino-6-methyl-7-anilino-fluoran | 200 g |
| Malon MS-25 | 24 g |
| Water | 276 g |
| The above mixture is ground and dispersed for 48 hr in a ball mill. | |
| (4) Fluid D (dispersion of a fatty acid amide) | |
| Stearamide (manufactured by Kao Corporation, brand name Fatty Amide S, m.p. 103 to 105° C.) | 150 g |
| 10% Aqueous solution of an ammonium salt of a styrene-maleic anhydride copolymer | 75 g |
| Water | 275 g |
| The above mixture is ground and dispersed for 48 hr in a ball mill. | |

Using the dispersion fluids A to D thus obtained, there was prepared a heat-sensitive coating color having the following composition.

| | |
|---|---|
| Calcium carbonate (manufactured by Shiraishi Kogyo Kaisha, Ltd., brand name PC) | 5 g |
| Fluid A | 17 g |
| Fluid B | 5.7 g |
| Fluid C | 6 g |
| Fluid D | 3.3 g |
| Aqueous solution containing 15% by weight of a polyvinyl alcohol | 22 g |
| Water | 23 g |

The coating color prepared above was coated on a base paper of 50 g/m$^2$ so that the coated quantity after drying became 6.8 g/m$^2$, and the coated paper was dried for 1 min at 60° C. to obtain a heat-sensitive paper.

EXAMPLE 2

A coating color was prepared in the same manner as in Example 1 except that dimethyl terephthalate used in Fluid B of Example 1 was replaced by monobutyl terephthalate (m.p. 122° to 124° C.). This coating color was coated on a base paper of 50 g/m$^2$ so that the coated quantity after drying became 6.8 g/m$^2$, and the coated paper was dried for 1 min at 60° C. to obtain a heat-sensitive paper.

EXAMPLE 3

A coating color was prepared in the same manner as in Example 1 except that stearamide used in Fluid D of Example 1 was replaced by ethylene-bis-stearamide (manufactured by Kao Corporation, brand name Kao Wax EB-F, m.p. 141° to 146.5° C.). This coating color was coated on a base paper of 50 g/m$^2$ so that the coated quantity after drying became 6.8 g/m$^2$, and the coated paper was dried for 1 min at 60° C. to obtain a heat-sensitive paper.

COMPARATIVE EXAMPLES 1 TO 3

Using Fluids A, B, C and D shown in Example 1 optionally, there were prepared heat-sensitive coating colors having the following compositions. Each of these coating colors was coated on a base paper of 50 g/m$^2$ so that the coated quantity after drying became a quantity shown in the following Table, and then the coated papers were dried for 1 min at 60° C. to obtain heat-sensitive papers.

| | Comparative Example | | |
|---|---|---|---|
| | 1 | 2 | 3 |
| Calcium carbonate PC | 5 g | 5 g | 5 g |
| Fluid A | 17 | 17 | 17 |
| Fluid B | — | 8.6 | — |
| Fluid C | 6 | 6 | 6 |
| Fluid D | — | — | 10 |
| Aqueous solution of 15% by weight of a polyvinyl alcohol | 17.9 | 22 | 22 |
| Water | 21.1 | 23.4 | 22 |
| Coated quantity, g/m$^2$ | 5.4 | 6.6 | 6.6 |

PERFORMANCE TEST 1

Heat-sensitive papers of Examples 1 to 3 and Comparative Examples 1 to 3 were subjected to calendering by the use of a super calender so that the Bekk smoothness of each paper became about 400 to 500 sec. Then, recordings were made for each paper in constant temperature rooms having the following fixed atmospheres by the use of Facom Fax 621 C which is a facsimile manufactured by Fujitsu Limited, and subsequently densities of developed colors were measured.

Test a: Record density at 18° C. (general room temperature)

Test $b_1$: Record density at 5° C. (low temperature for test)

Test $b_2$: Record density at 0° C. (low temperature for test)

For developed color portions of papers obtained in Test a, the following tests were conducted.

Test c: Image retention when an image has been retained for 24 hr in an atmosphere of 60° C.

Test d: Image retention when an image has been retained for 24 hr in an atmosphere of 40° C. and 90% relative humidity In the above tests, density measurement was made by the use of an amber filter of Sakura densitometer PDA 45.

The results are shown below.

| | Test a (Record density at 18° C.) | Test $b_1$ (Record density at 5° C.) | Test c (Image retention %) | Test d (Image retention %) |
|---|---|---|---|---|
| Example 1 | 1.24 | 1.20 | 84.7 | 81.7 |
| Example 2 | 1.24 | 1.18 | 89.9 | 90.1 |
| Example 3 | 1.22 | 1.16 | 92.0 | 90.5 |
| Comparative Example 1 | 0.92 | 0.72 | 76.2 | 74.4 |
| Comparative Example 2 | 1.09 | 0.95 | 80.4 | 79.2 |
| Comparative | 1.02 | 0.90 | 71.9 | 70.2 |

-continued

| | Test a (Record density at 18° C.) | Test $b_1$ (Record density at 5° C.) | Test c (Image retention %) | Test d (Image retention %) |
|---|---|---|---|---|
| Example 3 | | | | |

As obvious from the above table, among heat-sensitive papers using benzyl p-hydrobenzoate as a color developer, those using both a terephthalic acid ester having a melting point of 60° C. or higher and a fatty acid amide or derivative thereof having a melting point of 60° C. or higher show higher color development sensitivities than those using either or neither of said terephthalic acid ester and said fatty acid amide or derivative thereof. This trend is more striking in recordings in low temperature atmospheres.

Further, those of Examples 1 to 3 show superior results also in image retention.

EXAMPLE 4

A heat-sensitive paper was prepared in the same manner as in Example 1 except that 5 g of calcium carbonate used in Example 1 was replaced by 1 g of calcium carbonate and 4 g of silicon oxide (manufactured by Mizusawa Kagaku K.K., brand name Mizucasil).

COMPARATIVE EXAMPLES 4 AND 5

Heat-sensitive papers of Comparative Examples 4 and 5 were prepared in the same manner as in Example 4 except that benzyl p-hydroxybenzoate used in Fluid A of Example 4 was replaced by bisphenol A (BPA) and also stearamide used in Fluid D was replaced respectively by paraffin wax and polyethylene wax.

COMPARATIVE EXAMPLE 6

A heat-sensitive paper was prepared in the same manner as in Comparative Example 4 except that Fluid B was not employed.

COMPARATIVE EXAMPLE 7

A heat-sensitive paper was prepared in the same manner as in Example 4 except that benzyl p-hydroxybenzoate used in Fluid A of Example 4 was replaced by BPA and Fluid B was not employed.

COMPARATIVE EXAMPLE 8

A heat-sensitive paper was prepared in the same manner as in Example 4 except that benzyl p-hydroxybenzoate used in Fluid A of Example 4 was replaced by BPA, dimethyl terephthalate used in Fluid B was replaced by dibenzyl isophthalate, and Fluid D was not employed.

EXAMPLE 5

A heat-sensitive paper was prepared in the same manner as in Example 4 except that dimethyl terephthalate used in Fluid B of Example 4 was replaced by dibenzyl terephthalate.

The results of Examples 4 and 5, and Comparative Examples 4 to 8 are shown in the table below.

| | Test a (Record density at 18° C.) | Test $b_2$ (Record density at 0° C.) | Test c (Image retention %) | Test d (Image retention %) |
|---|---|---|---|---|
| Example 4 | 1.23 | 1.19 | 96.8 | 89.4 |
| Example 5 | 1.29 | 1.26 | 94.4 | 97.6 |

-continued

| | Test a (Record density at 18° C.) | Test $b_2$ (Record density at 0° C.) | Test c (Image retention %) | Test d (Image retention %) |
|---|---|---|---|---|
| Comparative Example 4 | 1.03 | 0.75 | 93.8 | 98.0 |
| Comparative Example 5 | 1.05 | 0.96 | 99.1 | 103.8 |
| Comparative Example 7 | 0.94 | 0.82 | 95.3 | 109.9 |
| Comparative Example 6 | 0.71 | 0.62 | 100.0 | 107.8 |
| Comparative Example 8 | 0.92 | 0.78 | 87.6 | 109.4 |

As obvious from the above table, the heat-sensitive papers using benzyl p-hydrobenzoate as a color developer and also using both a terephthalic acid ester having a melting point of 60° C. or higher and a fatty acid amide or derivative thereof having a melting point of 60° C. or higher (Examples 4 and 5) show higher color development sensitivities than the heat-sensitive papers using BPA as a color developer and also using paraffin wax and polyethylene wax instead of the fatty acid amide (Comparative Examples 4 and 5), that using no terephthalic acid ester in Comparative Example 4 (Comparative Example 6), that using stearamide instead of paraffin wax in Comparative Example 6 (Comparative Example 7), and that using BPA as a color developer and also using dibenzyl isophthalate, but no fatty acid amide (Comparative Example 8). This trend is more striking in recordings in low temperature atmospheres.

Besides, in the scope of the present invention, a further improvement in the color development sensitivity, particularly under low temperature atmospheres, can be expected in case of the heat-sensitive paper using dibenzyl terephthalate (Example 4) better than in case of that using dimethyl terephthalate (Example 5).

What is claimed is:

1. A heat-sensitive recording sheet having a heat-sensitive coating layer comprising a colorless to light-colored dye precursor as color former and a color developer which causes said dye precursor to develop a color by reacting with said dye precursor when heated, characterized in that benzyl p-hydroxybenzoate is used as said color developer and said heat-sensitive coating layer further comprises a terephthalic acid ester having a melting point of 60° C. or higher and a fatty acid amide or derivative thereof having a melting point of 60° C. or higher.

2. A heat-sensitive recording sheet according to claim 1, wherein the amount of said fatty acid amide or derivative thereof is 10 to 100% by weight based on the amount of benzyl p-hydroxybenzoate.

3. A heat-sensitive recording sheet according to claim 2, wherein said amount is 10 to 60% by weight.

4. A heat-sensitive recording sheet according to claim 3, wherein said amount is 15–20% by weight.

5. A heat-sensitive recording sheet according to claim 1, wherein the amount of said terephthalic acid ester is 10 to 100% by weight based on the amount of benzyl p-hydroxybenzoate.

6. A heat-sensitive recording sheet according to claim 5, wherein said amount is 10 to 60% by weight.

7. A heat-sensitive recording sheet according to claim 6, wherein said amount is 30–35% by weight.

8. A heat-sensitive recording sheet according to claim 1, wherein the amount of the fatty acid amide or derivative thereof is 10 to 100% by weight and simultaneously the amount of the terephthalic acid ester is 10 to 100% by weight, respectively, based on the amount of benzyl p-hydroxybenzoate.

9. A heat-sensitive recording sheet according to claim 8, wherein the amount of the fatty acid amide or derivative thereof is 10–60% by weight and simultaneously the amount of the terephthalic acid ester is 10–60% by weight.

10. A heat-sensitive recording sheet according to claim 9, wherein the amount of the fatty acid amide or derivative thereof is 15–20% by weight and simultaneously the amount of the terephthalic acid ester is 30–35% by weight.

11. A heat-sensitive recording sheet according to claim 1, wherein the total amount of the terephthalic acid ester and the fatty acid amide or derivative thereof does not exceed 1.2 times by weight of the amount of said color developer.

12. A heat-sensitive recording sheet according to claim 11, wherein said total amount does not exceed 0.6 time by weight of the amount of said color developer.

13. A heat-sensitive recording sheet according to claim 1, wherein the heat-sensitive coating layer comprises 15–30% by weight of pigments based on the total solids of the heat-sensitive coating layer.

14. A heat-sensitive recording sheet according to claim 13, wherein the pigment is calcium carbonate.

15. A heat-sensitive recording sheet according to claim 13, wherein the pigment is silicon oxide (silica).

16. A heat-sensitive recording sheet according to claim 13, wherein the pigment is a combination of calcium carbonate and silica.

17. A heat-sensitive recording sheet according to claim 16, wherein the weight ratio of calcium carbonate to silica is 1:9 to 3:7.

18. A heat-sensitive recording sheet according to claim 13, wherein the heat-sensitive coating layer comprises benzyl p-hydroxybenzoate in 2–3 times by weight based on the dye; stearamide and/or ethylene bis-stearamide as the fatty acid amide or derivative thereof in 15–20% by weight based on the color developer; dimethyl terephthalate and/or monobutyl terephthalate and/or dibenzyl terephthalate as the terephthalic acid ester in 30–35% by weight based on the color developer; and calcium carbonate and/or silica as the pigment in 15–30% by weight based on the total solids of the heat-sensitive coating layer.

19. A heat-sensitive recording sheet according to claim 18, wherein the weight ratio of calcium carbonate to silica is 1:9 to 3:7.

20. A heat-sensitive recording sheet according to claim 1, wherein the fatty acid amide or derivative thereof is stearamide.

21. A heat-sensitive recording sheet according to claim 1, wherein the fatty acid amide or derivative thereof is ethylene bis-stearamide.

22. A heat-sensitive recording sheet according to claim 1, wherein the terephthalic acid ester is dimethyl terephthalate.

23. A heat-sensitive recording sheet according to claim 1, wherein the terephthalic acid ester is monobutyl terephthalate.

24. A heat-sensitive recording sheet according to claim 1, wherein the terephthalic acid ester is dibenzyl terephthalate.

* * * * *